US007178198B2

(12) United States Patent
Elmer

(10) Patent No.: US 7,178,198 B2
(45) Date of Patent: Feb. 20, 2007

(54) MOUNTING ARRANGEMENT FOR GLASS DOORS

(75) Inventor: Hubert Elmer, Innsbruck (AT)

(73) Assignee: Dorma GmbH + Co., KG, Ennepetal (DE)

( * ) Notice: Subject to any disclaimer, the term of this patent is extended or adjusted under 35 U.S.C. 154(b) by 172 days.

(21) Appl. No.: 10/515,490

(22) PCT Filed: Oct. 24, 2003

(86) PCT No.: PCT/EP03/11829

§ 371 (c)(1),
(2), (4) Date: Nov. 23, 2004

(87) PCT Pub. No.: WO2004/038153

PCT Pub. Date: May 6, 2004

(65) Prior Publication Data

US 2005/0198776 A1 Sep. 15, 2005

(30) Foreign Application Priority Data

Oct. 25, 2002 (DE) ..... 102 50 978

(51) Int. Cl.
*E05D 5/02* (2006.01)
*E05D 11/10* (2006.01)

(52) U.S. Cl. ..... 16/252; 16/239; 49/388

(58) Field of Classification Search ..... 16/252, 16/250, 332, 239, 241, 262, 382, 235, 230, 16/231; 49/399, 388, 381, 383, 397, 398, 49/501; 52/204.62, 204.65, 656.4; 160/187, 160/223, 380, 402
See application file for complete search history.

(56) References Cited

U.S. PATENT DOCUMENTS

| | | | | |
|---|---|---|---|---|
| 1,942,510 A * | 1/1934 | Freiberg | ..... | 16/259 |
| 3,828,394 A * | 8/1974 | Horgan, Jr. | ..... | 16/241 |
| 5,497,586 A | 3/1996 | Dodd et al. | | |
| 6,070,294 A * | 6/2000 | Perkins et al. | ..... | 16/252 |

(Continued)

FOREIGN PATENT DOCUMENTS

| | | |
|---|---|---|
| DE | 21 43 263 | 3/1973 |

(Continued)

*Primary Examiner*—Katherine Mitchell
*Assistant Examiner*—Andre' L. Jackson
(74) *Attorney, Agent, or Firm*—Cohen Pontani Lieberman & Pavane LLC

(57) ABSTRACT

A mounting arrangement for glass doors includes an upper mounting having a mounting body with a clamping device for the glass leaf and a displaceable bearing pin for engaging in a counterbearing at a transom and a lower mounting with a mounting body with a clamping device for the glass leaf, and with a receiving recess for a floor door closer or a floor bearing. The two mounting bodies are arranged parallel to the vertical axis (H) of the glass leaf, and each clamping device is provided with longitudinally extending grooves for receiving fastening screws which project through screw holes in the clamping device and bore holes in the glass leaf. A clamping insert is provided for inserting into the grooves and has a recess for a cover panel. The mounting body and the counterbearing can be covered by means of covers, wherein the cover is provided with elongated holes which extend under the clamping insert and cover panel. Lift-out protection is provided in the upper mounting for the all-glass leaf in the closed position.

20 Claims, 15 Drawing Sheets

U.S. PATENT DOCUMENTS

| | | | | |
|---|---|---|---|---|
| 6,178,595 | B1 * | 1/2001 | Marinoni | 16/252 |
| 6,526,627 | B2 * | 3/2003 | Chiang | 16/284 |
| 6,648,544 | B2 * | 11/2003 | Liu | 403/408.1 |
| 6,708,369 | B1 * | 3/2004 | Liao | 16/252 |
| 6,925,685 | B2 * | 8/2005 | Chen | 16/332 |
| 7,055,214 | B1 * | 6/2006 | Finkelstein | 16/248 |

FOREIGN PATENT DOCUMENTS

| | | |
|---|---|---|
| DE | 93 07 027 | 9/1994 |
| GB | 929 901 | 6/1963 |

* cited by examiner

MOUNTING ARRANGEMENT FOR GLASS DOORS

PRIORITY CLAIM

This is a U.S. national stage of application No. PCT/EP2003/011829, filed on 24Oct. 2003. Priority under 35 U.S.C. §119(a) and 35 U.S.C. §365(b) is claimed from German Application No. 102 50 978.9, filed 25 Oct. 2002.

BACKGROUND OF THE INVENTION

1. Field of the Invention

The invention is directed to a mounting arrangement for glass doors comprising an upper mounting or mounting having a mounting body with a clamping device for the glass leaf and comprising a displaceable bearing pin for engaging in a counterbearing at the transom or the like and comprising a lower mounting with a mounting body with a clamping device for the glass leaf, and with a receiving recess for a floor closer or a floor bearing.

2. Description of the Related Art

Mounting arrangements have been known for a long time. However, the mountings and the upper counterbearing which is supported at an overpanel or transom above the glass leaf of the glass door are generally oriented transverse to the vertical axis of the glass door. This spoils the overall visual effect because the substantially vertical overall orientation of the glass door is interrupted by transversely extending elements and is perceived by the observer as unattractive. Further, a side part located next to the glass door is often incorporated in the counterbearing resulting in a somewhat clumsy overall appearance.

Further, as a result of this design, a gap can form between the front edge of the side part and the front edge of the glass leaf facing the side part when the glass leaf is swiveled, so that the user can be pinched in this gap causing painful injuries.

DE 93 07 027 U1 is directed to an all-glass installation which essentially comprises a glass door and laterally adjoining wall elements, which are likewise made of glass, and a transom located above the door. A mounting whose lower and upper strip are not constructed in the conventional horizontal form, but rather are installed vertically, is used in this all-glass door. This makes it possible to place the device necessary for supporting the door so far out at the edge of the pane of glass that only a semi-circular bore hole is needed in the lower and upper area of the all-glass leaf, as well as the bore holes, located above, which are needed for fastening of mounting generally. The interconnection of glass elements is ensured by means of a connection element which requires only one centering bore hole and which can be mounted without great effort. The connection elements are designed in such a way that one half of the element is inserted into the bore hole of the glass plate from each side and these halves are joined by a connection element. The present invention proceeds from this generic prior art.

U.S. Pat. No. 5,497,586 discloses a glass door which is embedded by means of a circumferentially extending frame. There are corresponding horizontal mounting parts inside the frame for operative connection of the all-glass door to a lower and upper bearing.

DE 298 13 219 U1 discloses a mounting for an all-glass leaf which is crowned by caps. Different inserts can be inserted into the caps as an artistic possibility for aesthetic, visual purposes.

DE 299 24 319 U1 discloses a mounting system for the rotatable bearing support of a door leaf at a frame structure. A mounting of this kind comprises two mounting parts which are formed by an intermediate space extending longitudinally. The door leaf is clamped in between the mounting parts. Depending on function and use, the mounting parts are either connected by a web so as to form one piece or are formed completely separately. The mounting parts are fastened to one another from one side by corresponding screw elements.

SUMMARY OF THE INVENTION

Therefore, it is the object of the present invention to provide a mounting arrangement which achieves a visual/aesthetic effect and which is adapted to the overall arrangement of the glass door in a slender, delicate and unobtrusive manner.

According to the invention, each clamping device includes a pair of clamps which receive the leaf therebetween, each mounting body having a pair of longitudinal channels extending over respective clamps and a pair of screw holes which align with a pair of bore holes in the leaf for receiving fastening screws through the clamps and the leaf. A cover extends over each of the mountings, each cover having a pair of elongate apertures which align with respective channels. A clamping insert is received in each of the channels and extends over the cover, each insert having a recess and a pair of holes in the recess for the screws. A cover panel is received in each recess. The upper fitting carries a bearing pin which engages in a counterbearing at the transom, and the lower fitting has a recess for a door closer or a floor bearing. An additional cover may be provided for the counterbearing.

The mounting arrangements according to the invention are not visually obtrusive because they are fully integrated into the door. They are inconspicuous because the vertical orientation of the glass door is not interrupted by transversely extending elements and fits in with the overall arrangement in a slender and delicate manner.

A stationary side part which is preferably made of glass is arranged adjacent to the glass leaf and the transom; the upper mounting and the lower mounting and the counterbearing do not engage with the side part. In particular, this step underlines the unobtrusive, slender and delicate effect of the mounting arrangement according to the invention because the glass door is not fastened to the side part.

According to an advantageous further development, the glass leaf is provided at the top and bottom with a vertically extending glass cutout for receiving the upper mounting or lower mounting or a clamping device thereof. In addition, preferably two bore holes located one above the other vertically adjoining each glass cutout are provided for fastening to the clamping device. In this way, the upper or lower mounting or the clamping devices thereof can be fastened securely to the glass door on one hand and the delicate construction of the mounting/door unit can be supported in this way on the other hand.

In order to ensure a good mutual support between the glass leaf and clamping device according to an advantageous construction, every glass cutout has a diagonally extending contact edge which makes contact at an inclined surface provided in the clamping device.

The clamping device has a receptacle for the glass cutout with two oppositely located clamping surfaces for lateral contact at the glass leaf. Due to this construction, an effective transmission of force and a secure connection between the mounting and door can be achieved.

In order to avoid obtrusive fastening devices for fastening the clamping devices to the glass leaf, the clamping device is provided with longitudinally extending grooves for receiving fastening screws which penetrate through screw holes in the clamping device and the bore holes in the glass leaf.

A clamping insert is preferably provided for inserting into the channels in order to reinforce the channels and to ensure a bearing support of the fastening screws which is robust and free of play even over a longer period of use.

According to an advantageous further development, the clamping insert is provided with a receptacle for a cover panel. This not only has a positive influence on the overall visual appearance of the mounting arrangement, but also makes it possible to adapt to different colors, shapes, etc.

Visual adaptation of the mounting arrangement according to the invention can be further improved according to a preferred embodiment form when the mounting body and the counterbearing can be covered by a cover.

The cover preferably includes tubular pieces which can slide over the mounting body and counterbearing.

According to one embodiment form, only the mounting body and the counterbearing are covered by the tube. According to an alternative construction, however, the tube can also extend over the entire height of the glass leaf. This construction serves at the same time to protect against pinching because pinching between the side part and the glass leaf can be reliably prevented by reducing the existing gap.

Further, the mounting arrangement according to the invention is not visually obtrusive because it emphasizes the vertical orientation of the glass door due to its slender, delicate shape. Further, the cover offers great leeway for architectonic and design variants. According to an advantageous further development, the tube is provided with a longitudinal slot and covers the back edge of the glass leaf so that the tube fits well visually into the overall impression of the door.

When the tubular cover extends over the entire height of the glass leaf, another mounting part is provided to increase stability and to clamp the tube at the glass leaf, preferably in the middle area of the back edge of the glass leaf. This mounting part can be constructed in a manner similar to the upper and lower mounting. According to an advantageous further development, bore holes are provided in the glass leaf for fastening this mounting part.

The covers can be provided in different colors and/or shapes, e.g., round, semi-circular, angular, oval, etc., in order to adapt easily to any design variants.

In an advantageous further development, the cover is provided with elongated holes which extend under the clamping insert and cover panel so that the cover does not hinder fastening of the mountings or, in particular, the accessibility of the fastening screws. Therefore, the cover panel of the clamping insert can easily be removed when it is necessary to access the fastening screws.

The upper and lower mounting are preferably covered at their outwardly facing front side with a cover cap which is preferably made of plastic.

The bearing pin is advantageously supported in the upper clamping device so as to be displaceable in axial direction of this clamping device so that the glass leaf can be mounted simply and easily. In this way, the bearing pin can be conveniently inserted into the upper counterbearing.

The upper mounting may be provided with lift-out protection. The lift-out protection is outwardly inconspicuous because it is arranged beneath the mounting body that is crowned by cover caps or beneath a clamping device.

According to an advantageous further development, the bearing pin is fastened to the mounting body and/or to the clamping device for the all-glass leaf by means of at least one fastening screw. The fastening screw penetrates into and extends through the bearing pin orthogonal to the center axis of the bearing pin. The fastening screw is inserted into an elongated hole inside the mounting body and/or clamping device in such a way that the bearing pin is displaceable in direction of the vertical axis. The thread of the fastening screw penetrates into a threaded bore hole inside the bearing pin. By tightening the fastening screw when the bearing pin is extended, the latter is connected in a frictional and positive engagement to the mounting body and/or the clamping device.

Owing to the fact that the bearing pin is located inside a pocket hole, it is possible to introduce another screw element below the extended bearing pin, which other screw element likewise penetrates the mounting body and/or the clamping device orthogonal to the center axis of the bearing pin. Owing to the arrangement of the securing screw, namely at an offset of 180° to the fastening screw, it is not possible to disassemble the installed all-glass leaf when the door is closed. This can only be carried out when the securing screw on one side of the all-glass door and the fastening screw on the opposite side are unscrewed or loosened. However, this means that the mounting and/or the clamping device must be accessible from both sides of the door leaf.

If only the securing screw is removed after the covering has been removed on one side of the all-glass door, the bearing pin cannot be lowered due to the design because the fastening screw holds the bearing pin in its position even when the securing screw is removed. This is due to the fact that the fastening screw, which is offset by 180° relative to the securing screw, is accessible in this case within the space. The fastening screw can likewise be loosened and the bearing pin can accordingly penetrate into the mounting body and/or the clamping device only after opening the all-glass door. However, this can only be accomplished when the securing screw has been completely removed. When the securing screw is removed, the lower part of the pocket hole into which the bearing pin penetrates is cleared.

In another instance, if a person loosened only the fastening screw, the bearing pin could not penetrate down into the pocket hole because of the securing screw which is screwed in on the opposite side.

It is clear that an arrangement of the securing screw and fastening screw of the bearing pin such as is described above results in a simple but effective securing of the bearing pin. The step of providing a securing screw does not impair adjustability when inserting the glass door. The design of the mounting is not important.

Further details, features and advantages of the invention are indicated in the following description of a preferred embodiment example with reference to the drawings.

DETAILED DESCRIPTION OF THE PRESENTLY PREFERRED EMBODIMENTS

Figure 1:
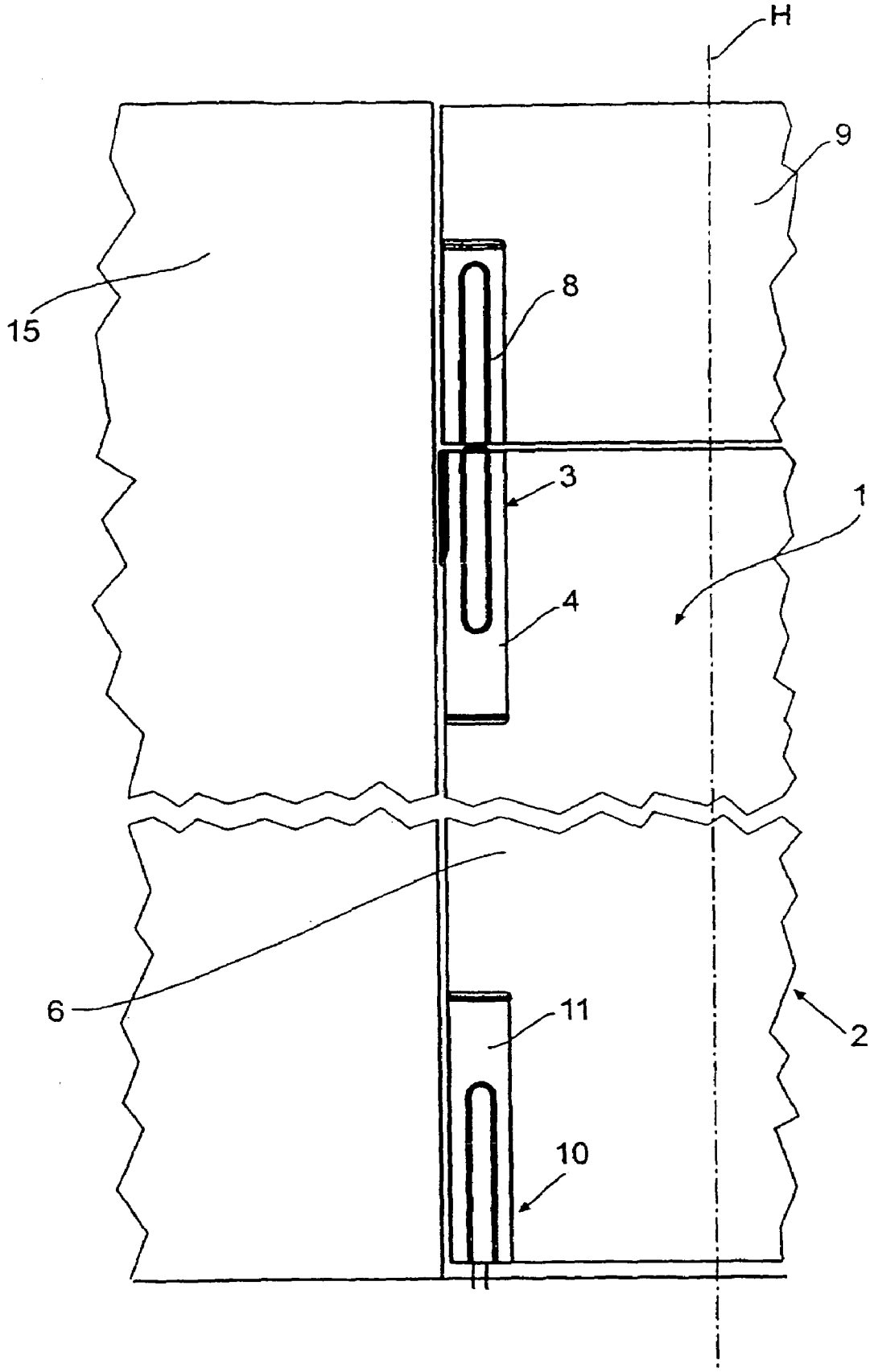
FIG. 1 is an overall view of a glass door with a mounting arrangement according to the invention.

The details of a mounting arrangement 1 according to the invention are shown in the drawings. A glass door 2 is shown only insofar as it pertains to the description of the invention.

FIG. 1 shows the glass door 2 only in the area of the mounting arrangement 1 according to the invention. The glass door 2 comprises a swivelable glass leaf 6, an overpanel or transom 9 which is arranged above the glass leaf 6 and which is preferably made of glass, and a side part 15 which is arranged next to the glass leaf 6 and transom 9 and which is likewise made of glass.

The glass leaf 6 is held exclusively in the transom or in the floor by means of the mounting arrangement 1 according to the invention. For this purpose, the mounting arrangement 1 comprises an upper mounting 3 and a lower mounting 10.

The upper mounting 3 has a mounting body 4 with a clamping device 5. The mounting body 4 has a bearing pin 7 which projects upward in the installed position and which can engage in a corresponding bearing opening in a counterbearing 8 which is fastened to the transom 9.

The lower mounting 10 likewise has a mounting body 11 with a clamping device 5'. The clamping device 5' has a receiving recess 12 for a floor closer 13 or a floor bearing 14 at a surface that faces downward in the installed position.

The arrangement and orientation of the lower mounting 10 and of the upper mounting 3 are carried out in such a way that the two mounting bodies 4, 11 are oriented parallel to a vertical axis H of the glass leaf 6. The counterbearing 8 is also preferably constructed like the mounting body 4, 11 and is arranged parallel to the vertical axis H of the glass leaf 6.

Figure 2:
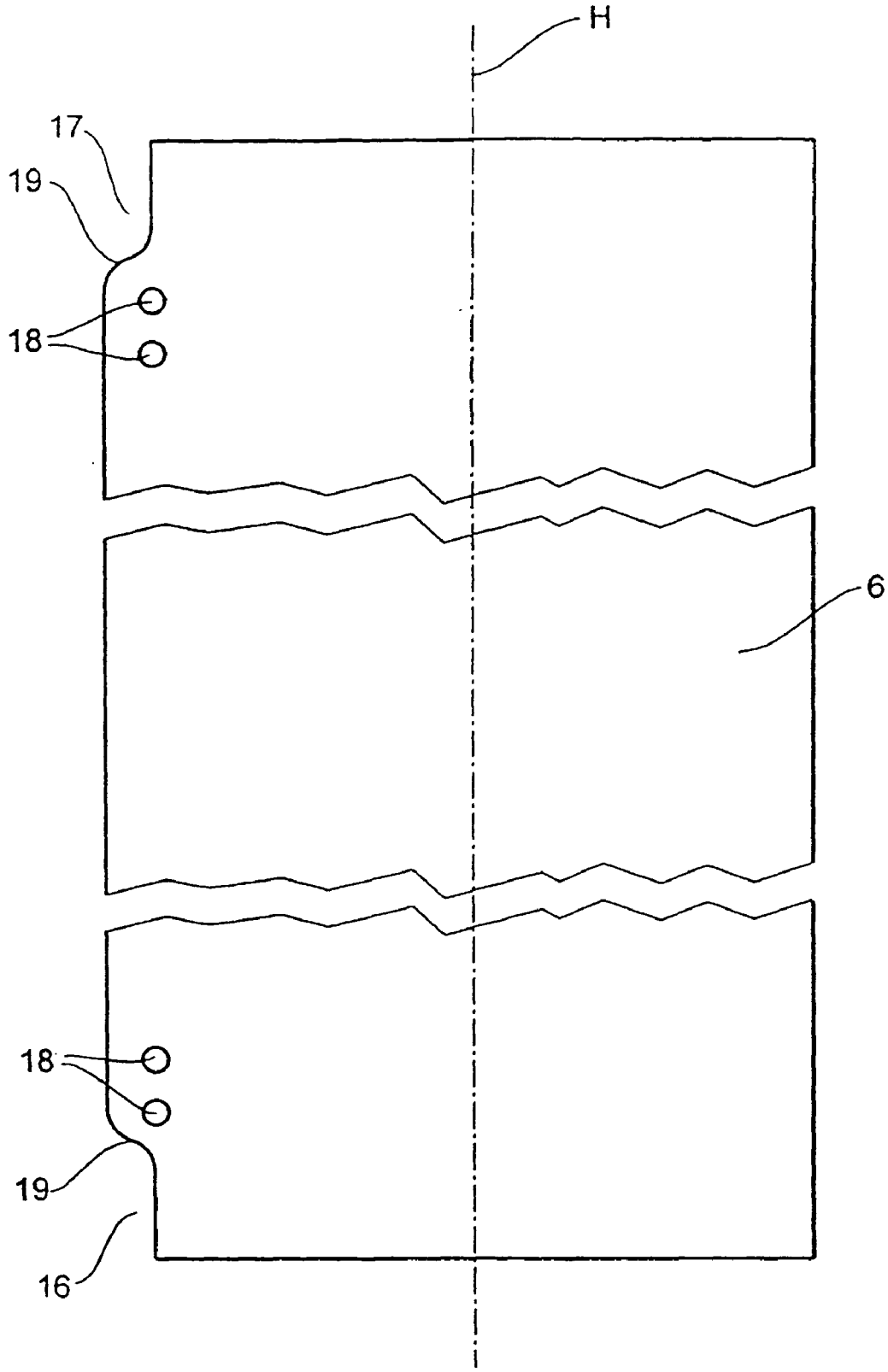
FIG. 2 shows a detailed view of the glass leaf of the glass door.

In order to ensure a secure fastening of the clamping device 5, 5' to the glass leaf 6, the glass leaf 6 is provided in its lower area with a glass cutout 16 which is so arranged that a cutout is open toward the side and toward the bottom (see FIG. 2). This glass cutout 16 passes over an inclined contact edge 19 into a side edge of the glass leaf 6. Two bore holes 18 arranged one behind the other vertically are arranged adjoining this glass recess 16.

Similarly, the glass leaf 6 is provided in its upper area with a glass cutout 17 which is arranged in such a way that there is a cutout which is open toward the side and toward the bottom (see FIG. 2). This glass cutout 17 likewise passes from an inclined contact edge 19 into a side edge of the glass leaf 6. Two bore holes 18 situated one behind the other vertically are arranged adjoining this glass recess 16 in this case also.

Figure 3:
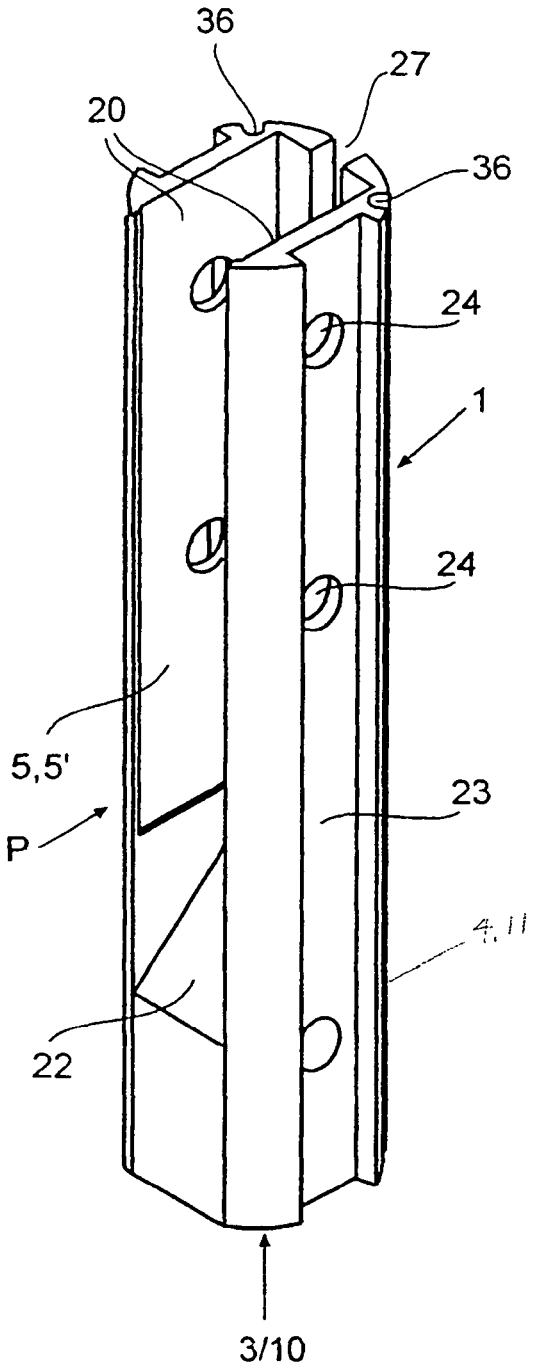
FIG. 3 shows a detailed view of the upper mounting arrangement according to the invention.

An upper or lower mounting 3, 10 of the mounting arrangement 1 according to the invention is shown in detail in FIG. 3. The upper or lower mounting 3, 10 is provided with a clamping device 5, 5' by means of which they can be fastened to the glass leaf 6.

The clamping device 5, 5' has a receptacle 21 with two lateral clamping surfaces 20 which contact the side surfaces of the glass leaf 6 in the installed state. The receptacle 21 is defined on one side by an inclined surface 22 which is contacted by the contact edge 19 of the glass leaf 6 in the installed state. Further, channels 23 which extend in longitudinal direction and in which screw holes 24 are located are provided in the side surfaces of the clamping device 5, 5' which face outward. Fastening elements, not shown, can be inserted into these screw holes 24. These fastening elements penetrate the screw holes 24 in the clamping device 5, 5' and the bore hole 18 in the glass leaf 6 in the installed state and accordingly hold the clamping devices 5, 5' securely and exactly in position at the glass leaf 6. In order to ensure a good contact of the clamping surfaces 20 at the glass leaf 6, the clamping device 5, 5' is provided with a slot 27 on its side facing away from the glass leaf 6.

The glass leaf 6 is held in the clamping device 5, 5' exclusively by clamping action. The fastening elements projecting through the screw holes 24 serve only to generate a clamping action between the clamping surfaces 20, but not to support the glass leaf 6.

Figure 12:
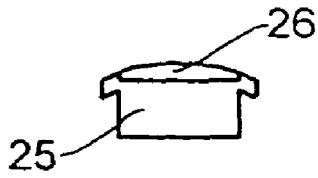
FIG. 12 shows a top view of the clamping insert according to FIG. 10.
Figure 10:
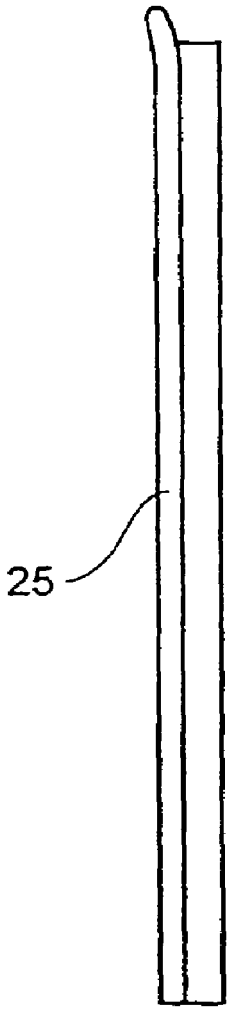
FIG. 10 shows a side view of a first embodiment form of a clamping insert.
Figure 11:
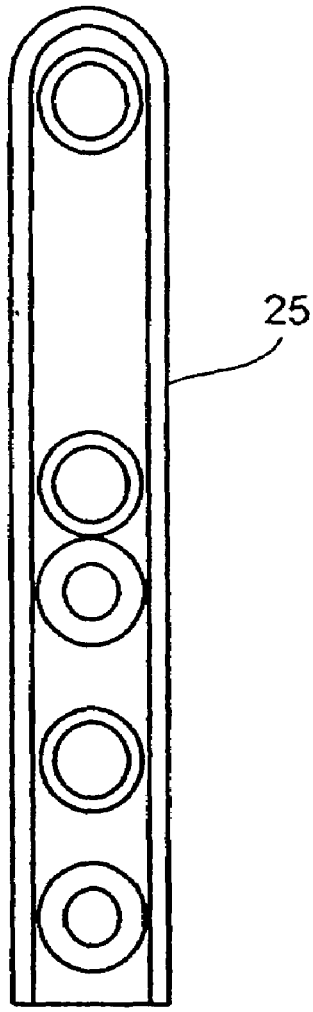
FIG. 11 shows a front view of the clamping insert according to FIG. 10.

A clamping insert 25 which penetrates the screw holes 24 can be inserted into a channel 23 for reinforcement. This clamping insert 25 in turn can be provided with a groove for receiving a cover panel 26 (See FIGS. 10 to 12).

Figure 4:
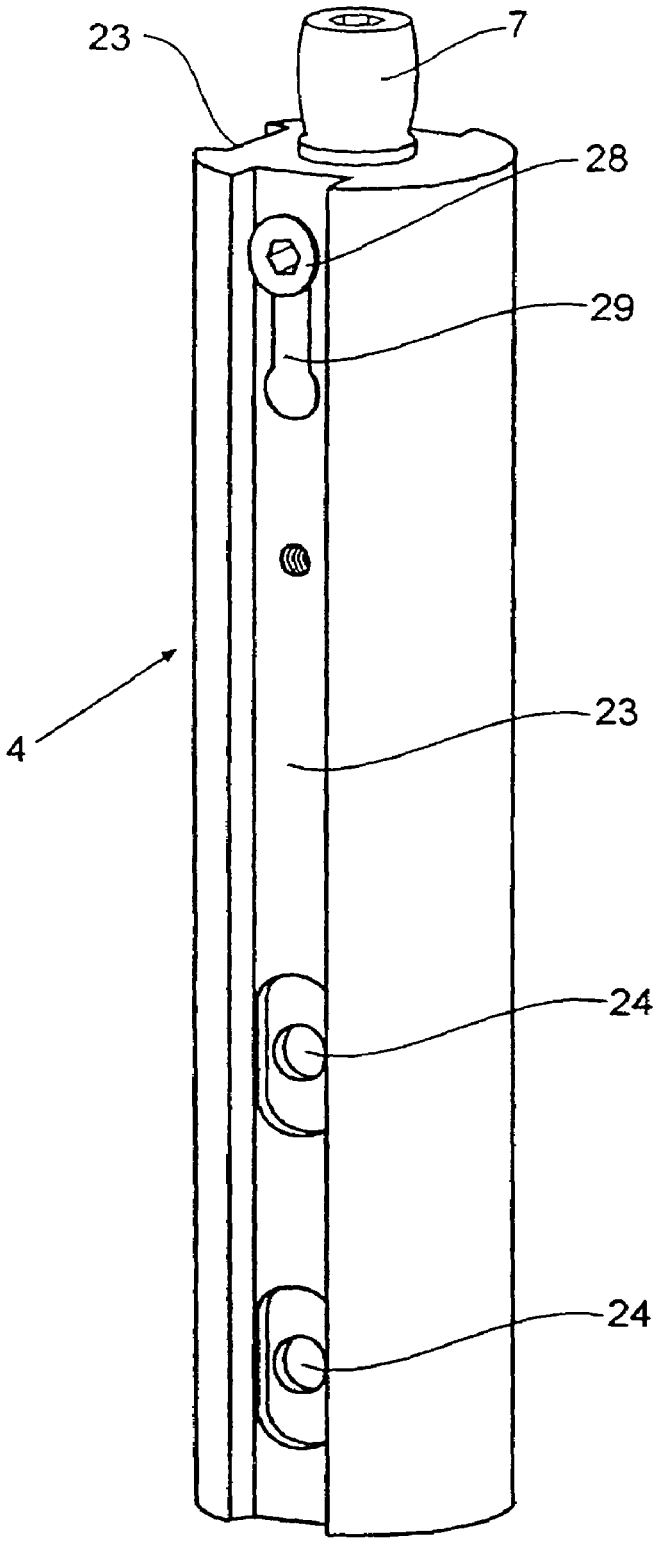
FIG. 4 shows another detailed view of the upper mounting arrangement, according to the invention, with extended bearing pin.
Figure 5:
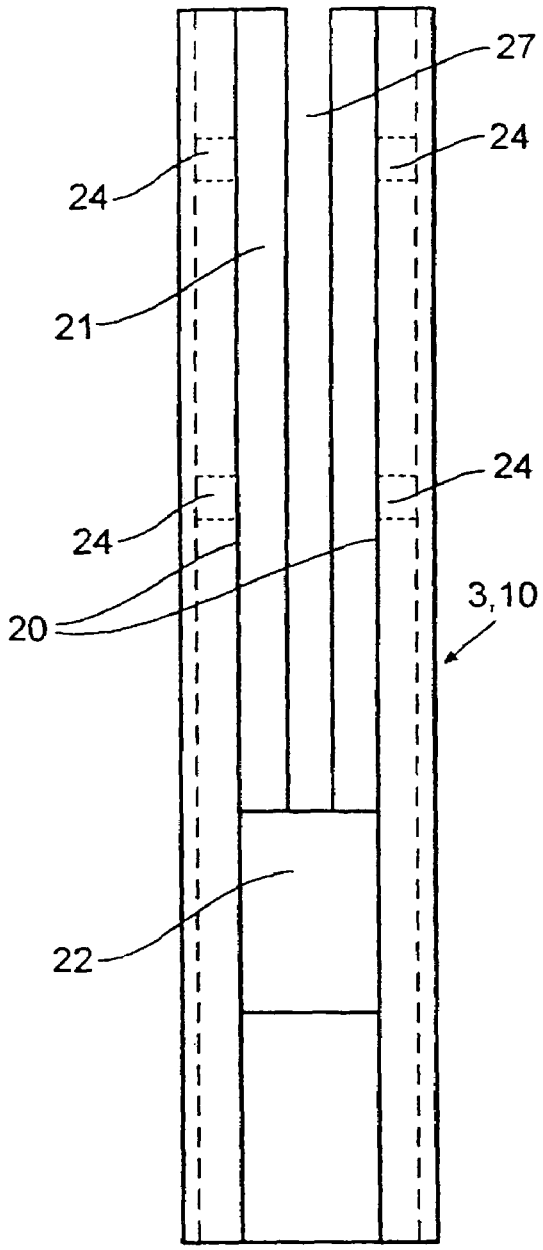
FIGS. 5–6 show two side views of the mounting according to FIG. 3 and FIG. 4.
Figure 6:
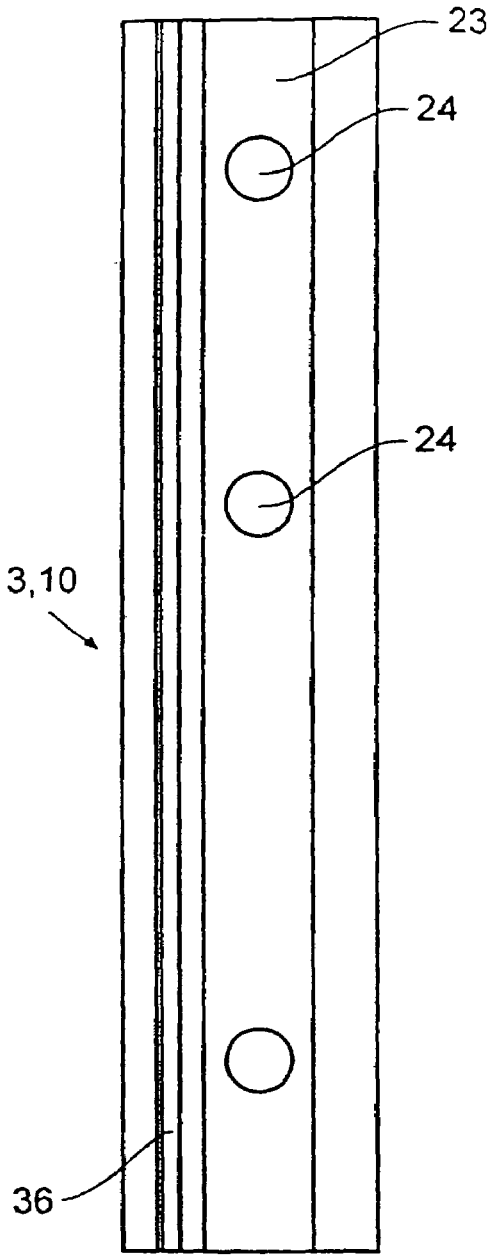

The upper mounting 3 is shown in FIG. 4. The bearing pin 7 which projects upward out of the mounting 3 serves to engage with the counterbearing 8. The bearing pin 7 is mounted so as to be displaceable in longitudinal direction of the mounting 3 so that the glass leaf 6 can be easily installed or, if necessary, also removed again. An adjusting screw 28, for example, is provided for this purpose. This adjusting screw 28 is arranged in the channel 23, is displaceable in an elongated hole 29 and is connected to the bearing pin 7 in a manner not shown in more detail. When the adjusting screw 28 is loosened, it can move downward in the elongated hole 29 out of the position shown in FIG. 4 and carries the bearing pin 7 along with it so that the latter disengages from the counterbearing 8. Conversely, when the adjusting screw 28 is moved upward in the elongated hole 29, the bearing pin 7 exits upward out of the mounting 3 and can engage with the counterbearing 8.

Figure 7:
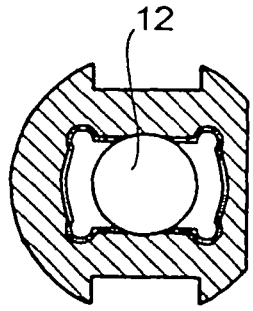
FIG. 7 shows a view of the lower mounting from below.
Figure 8:
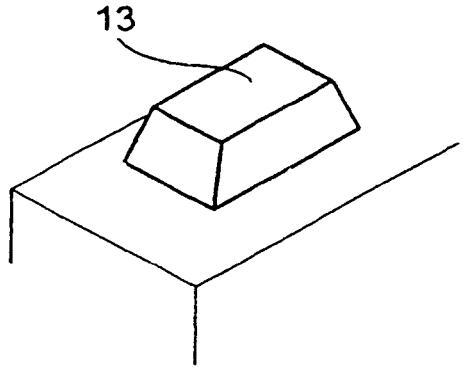
FIG. 8 shows a floor closer cooperating with the lower mounting.
Figure 9:
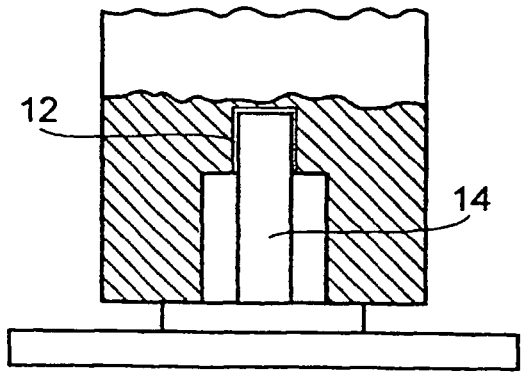
FIG. 9 shows a floor bearing cooperating with the lower mounting.

Two variants for supporting the lower mounting 10 are shown in FIGS. 7 to 9. Either a floor closer 13, according to FIG. 8, or a pin of a floor bearing 14 can engage in the receiving bore hole 12 provided in the lower mounting 10.

Figure 13:
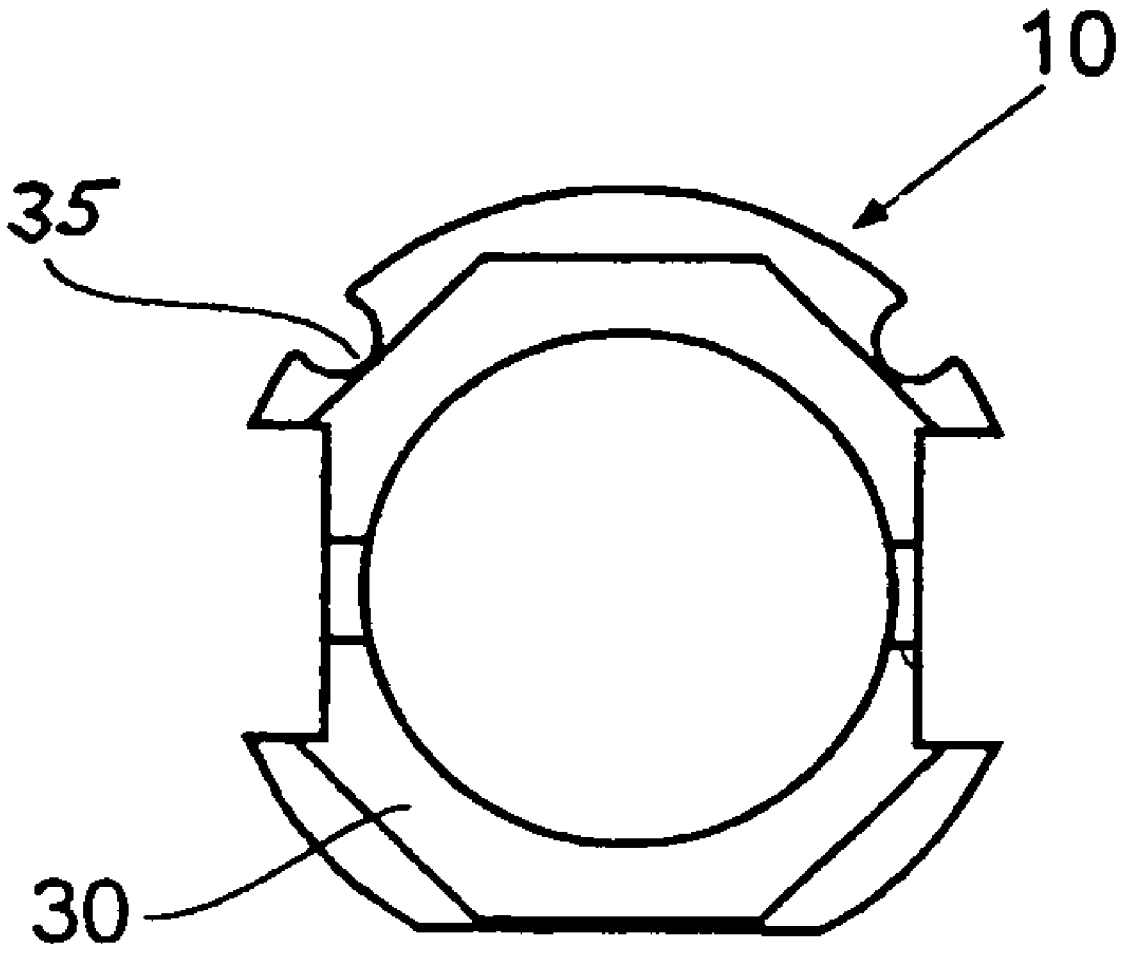
FIG. 13 shows a view of the lower mounting from below according to an alternative embodiment form.
Figure 14:
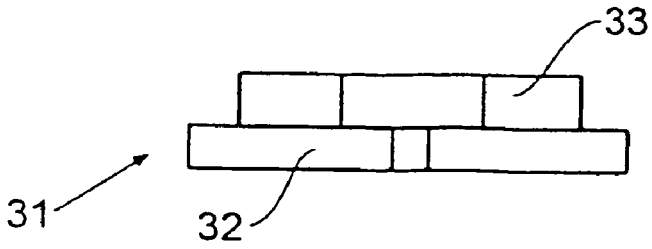
FIG. 14 shows a side view of an adapter for connecting to the lower mounting according to FIG. 13.
Figure 15:
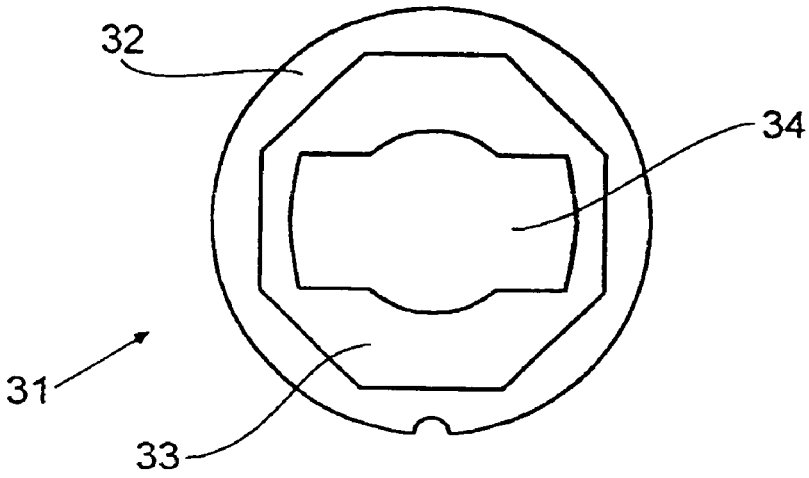
FIG. 15 shows a top view of the adapter according to FIG. 14.
Figure 16:
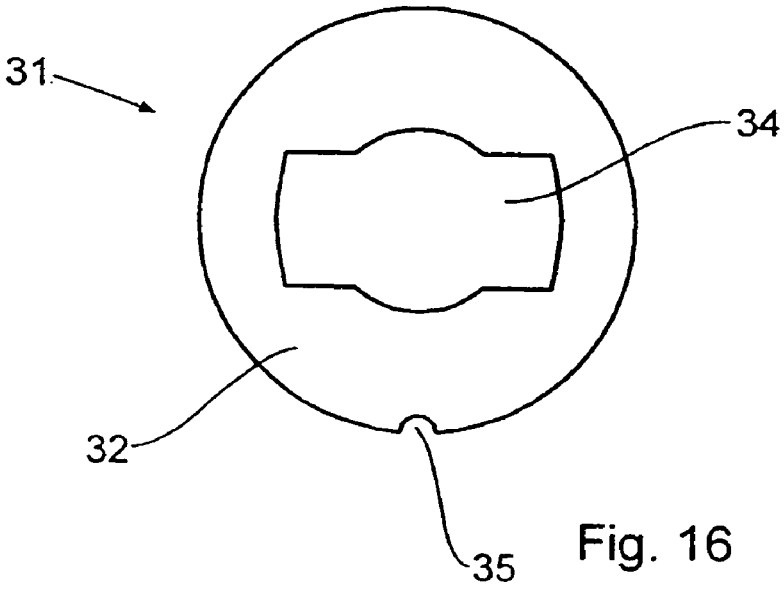
FIG. 16 shows a bottom view of the adapter according to FIG. 14.

An optional adapter 31 for an alternative floor bearing of the lower mounting 10 is shown in FIGS. 14 to 16. The lower mounting 10 has the shape shown in FIG. 13 with a hexagon opening 30. The adapter 31 shown in FIGS. 14 to 16 can be inserted into this hexagon opening 30.

The adapter 31 has a connection plate 32 from which a hexagon 33 extends upward, this hexagon 33 serving to engage with the hexagon opening 30 in the lower mounting 10. A receptacle 34 in which the floor closer 13 can engage is provided in the connection plate 32. Further, a notch 35 is provided in the connection plate 32 for adjustment and orientation.

The mounting arrangement 1 according to the invention is provided with additional covers 38. For this purpose, recesses 35 into which the covers 38 can be inserted can be arranged in the mountings 3, 10. The cover 38 can only extend over the mounting bodies 4, 11 and the counterbearing 8 or can extend over the entire height of the glass leaf 6. The covers 38 can have different shapes, e.g., round or angular, and/or different colors and, for example, can be made from tubes which are slid over the mountings 3, 10 and the counterbearing 8. The tube that is used as a cover 38 can be provided with a longitudinal slit in the shape of a cutout 46 and can cover the rear edge of the glass leaf 6. When the tube 38 extends over the entire height of the glass leaf 6, another mounting part, not shown, can be provided for clamping the tube 38 at the glass leaf 6, preferably in the center area of the rear edge. This mounting part which can be constructed similar to the upper or lower mounting 3, 10 can be fastened in the glass leaf 6 by means of bore holes.

The cover 38 is provided with lateral elongated holes which extend under the clamping insert and cover panel. Further, the upper or lower mounting 3, 10 can be covered by a cover cap 39, preferably made of plastic, at its front side facing outward.

The mounting arrangement 1 according to the invention can be used in single-leaf or two-leaf glass doors.

The mounting 3, 4 is connected to the glass leaf 2 by means of connection elements. For this purpose, longitudinal grooves in the form of recesses 21 can be provided in the mounting 3, 4 and clamping inserts can be inserted into these recesses 21 to improve the bearing support of the connection elements. The clamping inserts are covered externally by cover panels 38.

Figure 17:
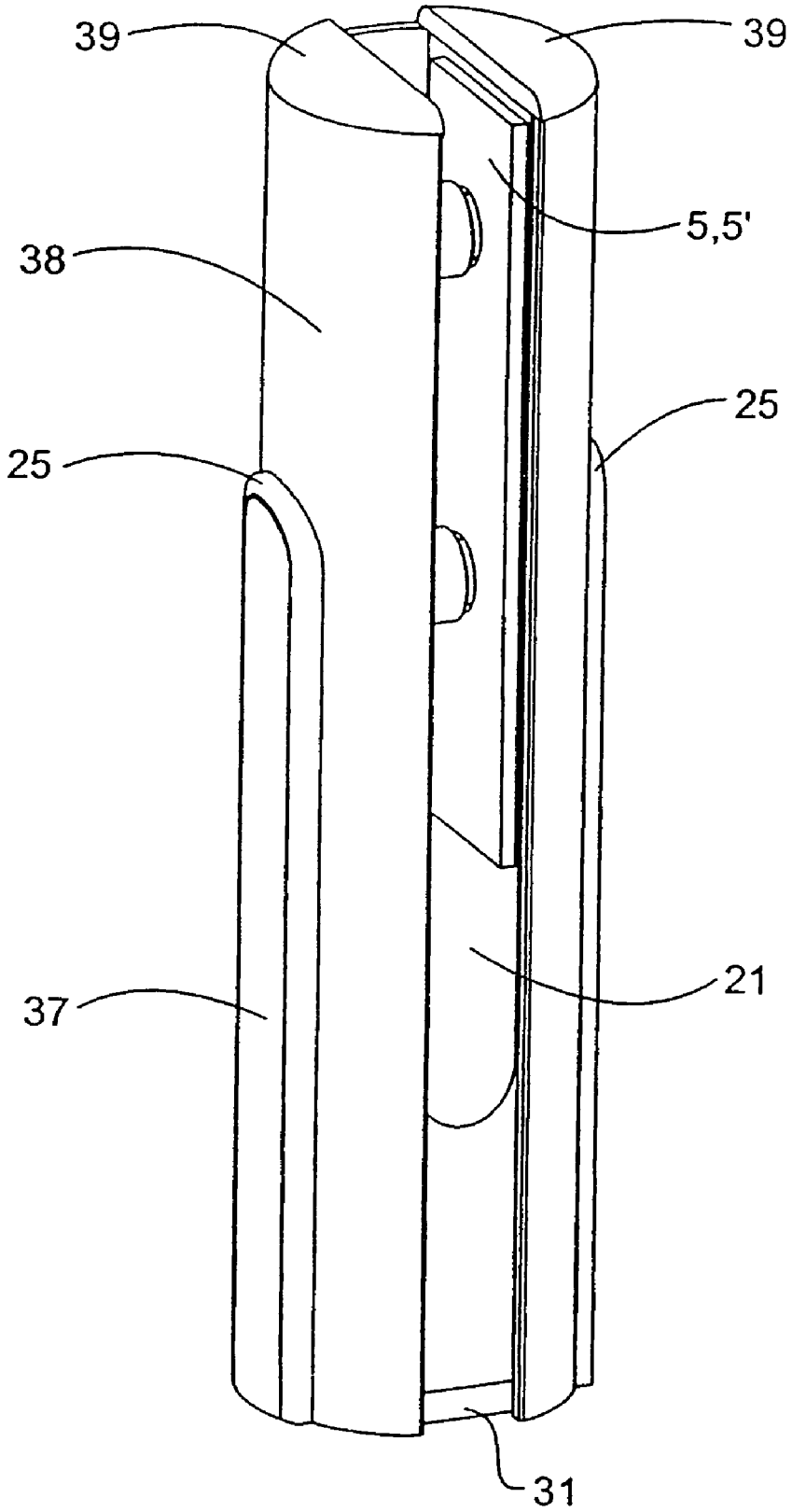
FIG. 17 shows a perspective view of a complete lower mounting.

In order to ensure easy access to the connection elements, the covers 38 are provided with elongated holes 43 which extend under the clamping insert 25 and its cover panel 26, 37 (see FIG. 17). The cover 38 is fixed to the mounting 3, 10 in this way. In addition, the front sides of the mountings 3, 10 which face outward are provided with a cover cap 39.

Different constructions can be realized by means of the mounting arrangement 1 described above with the upper mounting 3 and the lower mounting 10. One such construction is that described above in which the mounting bodies 4 are used as both upper mounting 3 and lower mounting 10, corresponding bearing pins 7 or adapters 31 being used in each instance to adapt to the surroundings. The bearing pin 7 and the adapter 31 are also provided in the mounting arrangement 1 when only the upper mounting 3 and the lower mounting 10 are not crowned by short covers 38 but, instead, when a continuous cover 38 is used over the entire vertical axis H of the glass door 2 from the top to the bottom in order to realize simultaneously a corresponding protective clamping protection relative to the secondary closing edge.

Figure 24:
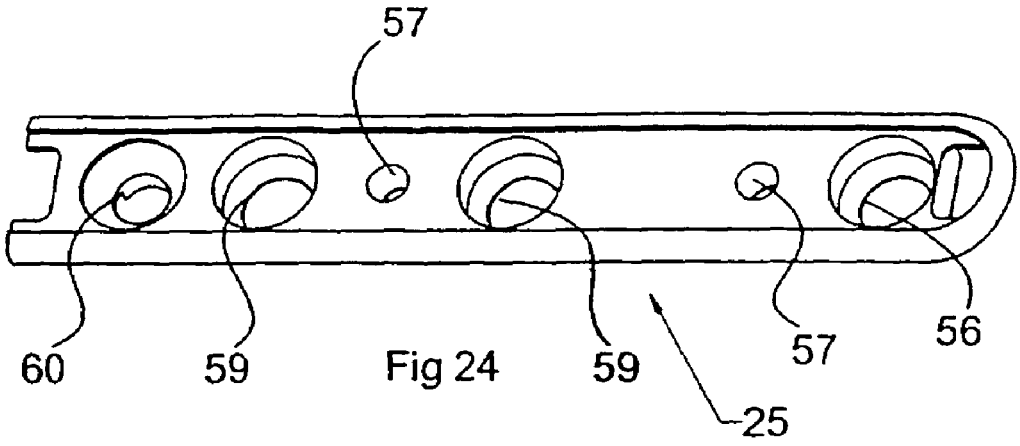
FIG. 24 shows a continuous covering for the upper and lower mounting.

FIG. 24 shows a continuous cover 38 of this kind in which the elongated holes in the form of openings 43 for the clamping inserts and accordingly for fastening the cover 38 to the mounting body 4 located under the latter can be realized in the form of clamping devices 5 and 5'. The opening 43 is surrounded on all sides by material so that the termination 45 is rounded for purposes of adapting in an attractive manner to the aesthetic attributes of the mounting. A cutout 46 extends over the entire length of the cover 38 according to FIG. 10, i.e., over the lower mounting 10 as well as over the upper mounting 3, in order to ensure that the glass door 2 penetrates into the tube 38. A border 44 forms the lower and upper termination of the cover 38. Projections 42 are formed inside the cover 38 in order to prevent rotation of the cover 38 on the mounting bodies 4 or clamping device 5, 5'.

Figure 20:
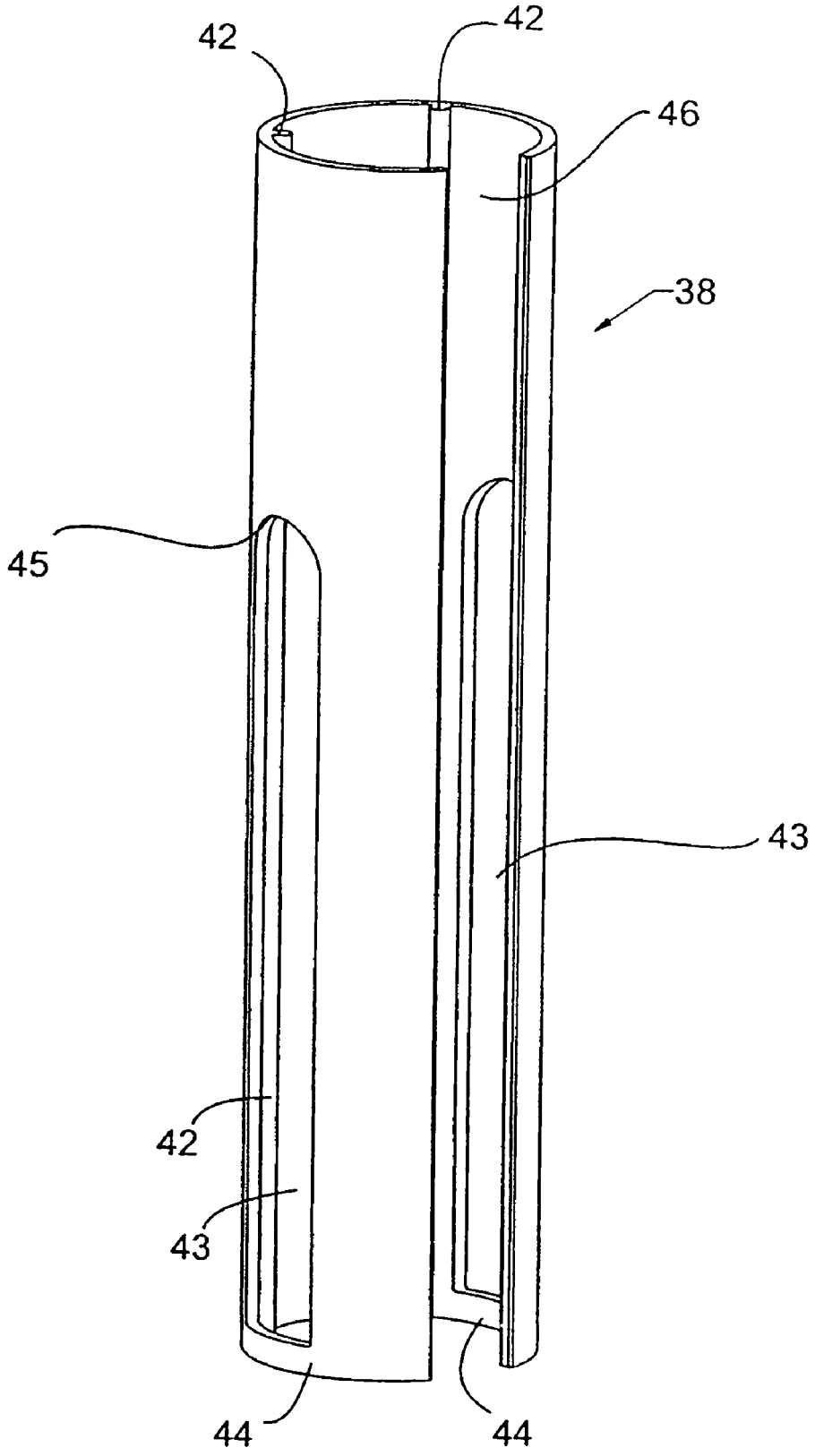
FIG. 20 shows a covering in a perspective view.

A cover 38 which is used only for an upper mounting 3 or a lower mounting 10 or a counterbearing 8 can be seen in FIG. 20. The corresponding opening 43 and the projections 42 are both provided. This cover 38 is likewise fastened by means of clamping inserts 25, so that no fasteners are visible at the cover 38.

An overall view of a mounted lower mounting 10 is shown in FIG. 17 for purposes of illustration. The glass door 2 is not shown for the sake of clarity. The cover 38 crowns the mounting with the clamping device 5, 5' and the adapter 31. The clamping inserts 25 which will be described in more detail and in which a covering 37 in the form of a plastic covering is inserted form the outer termination.

Figure 18:
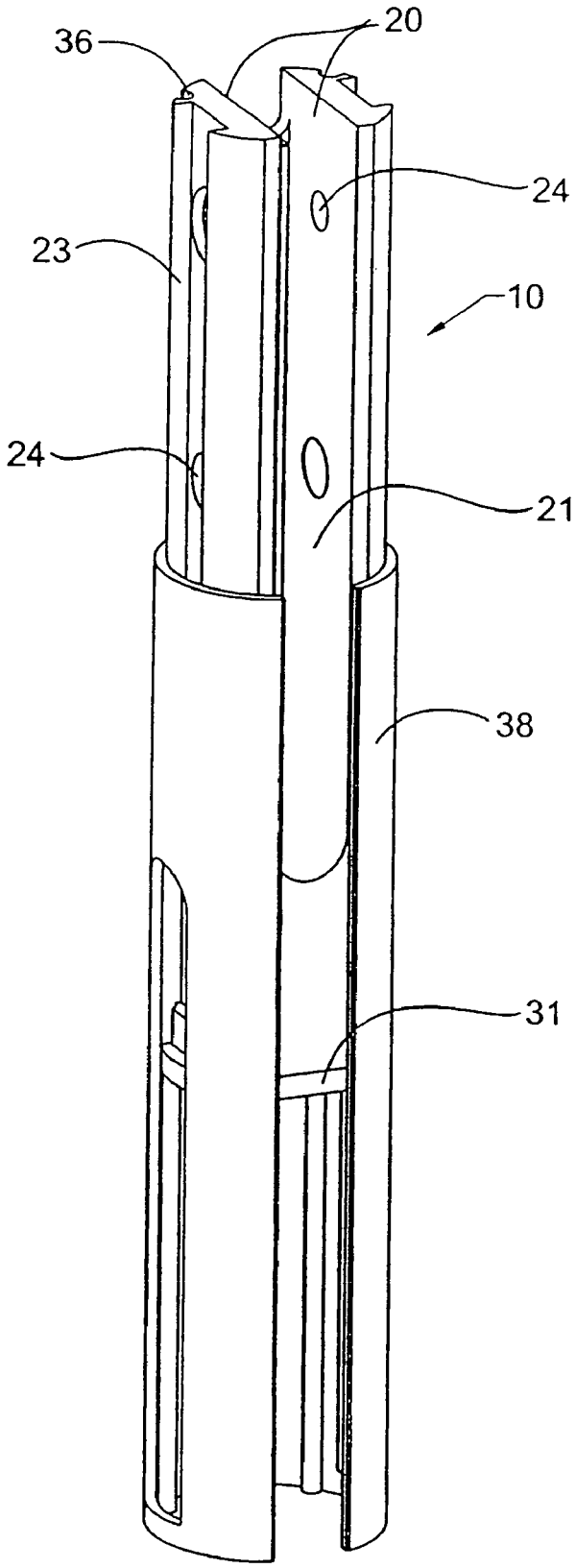
FIG. 18 shows a view similar to FIG. 17 but with the covering partially slid off.

It is clear from FIG. 18 that the cover 38 is slid over the lower mounting 10. The projections 42 engage in grooves 36 of the lower mounting 10 in order to prevent the cover 38 from rotating relative to the lower mounting 10. Further, it is clear that the channels 23 and the screw holes 24 are covered by the cover 38.

An exploded view of the lower mounting 10 in FIG. 19 makes clear once again how the cover 38 is fastened to the mounting body 11 after the mounting body or clamping device 5' is crowned without any fastening means being outwardly visible.

Figure 19:
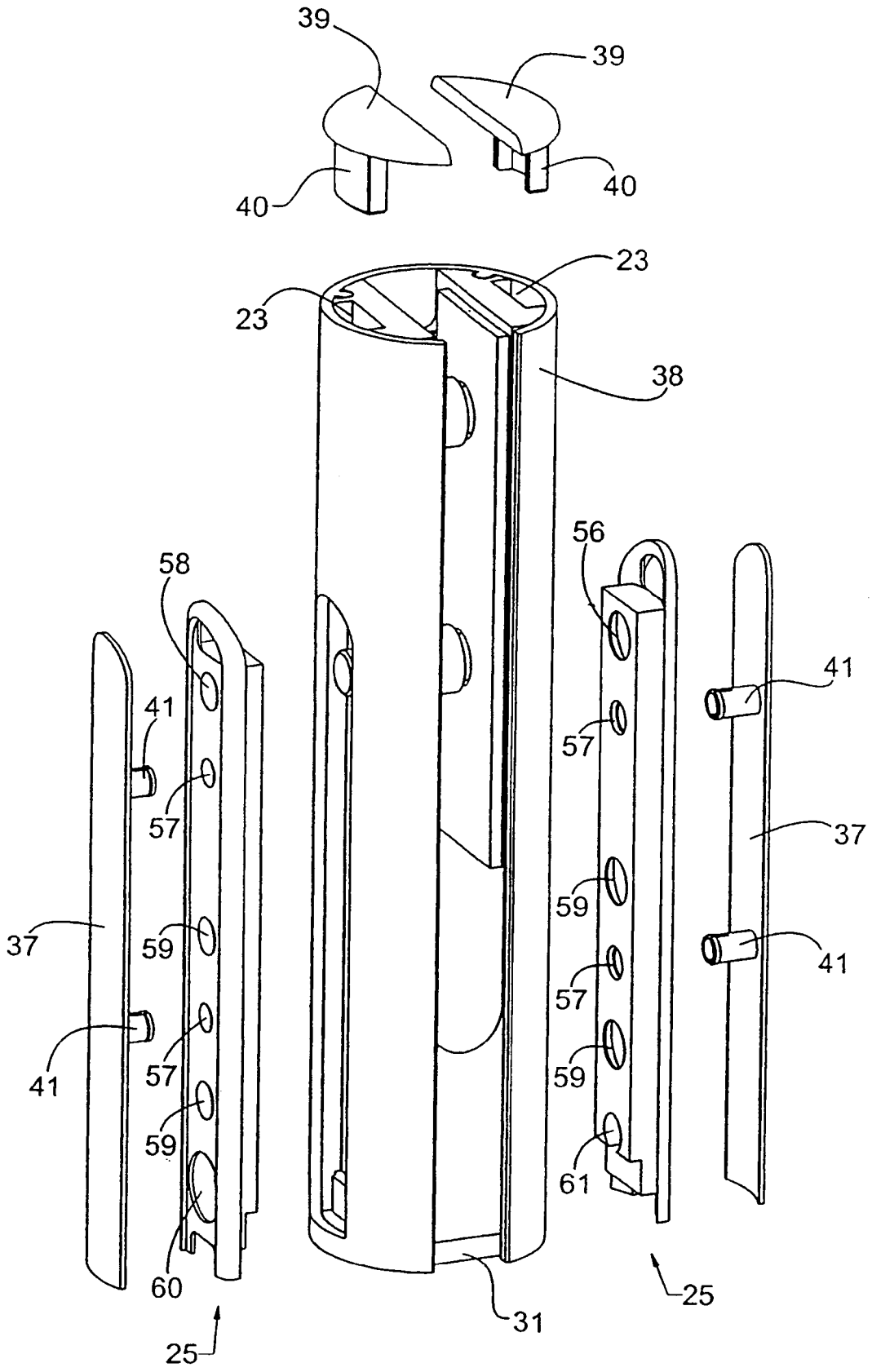
FIG. 19 shows a complete lower mounting in an exploded view.

Cover caps 39 form the upper termination of the mounting according to FIG. 19, a projection 40 that is inserted in the channels 23 being formed at each cover cap 39. The caps 39 are preferably made of an appropriate plastic.

The cover 38 is connected indirectly to the clamping device 5, 5' in the direction of the vertical axis H of the mounting arrangement 1 by corresponding screw elements.

Figure 22:
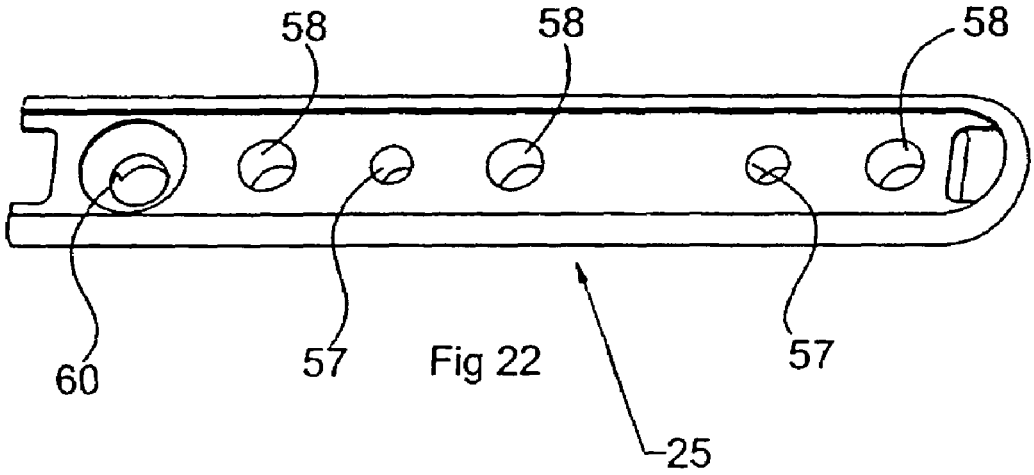
FIGS. 22–23 show other constructions of different clamping inserts.
Figure 23:
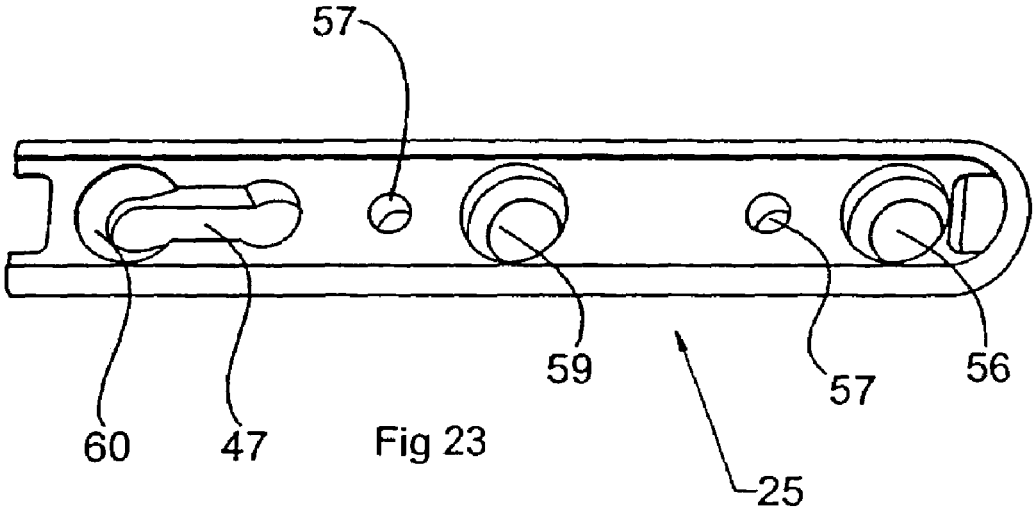
Figure 25:
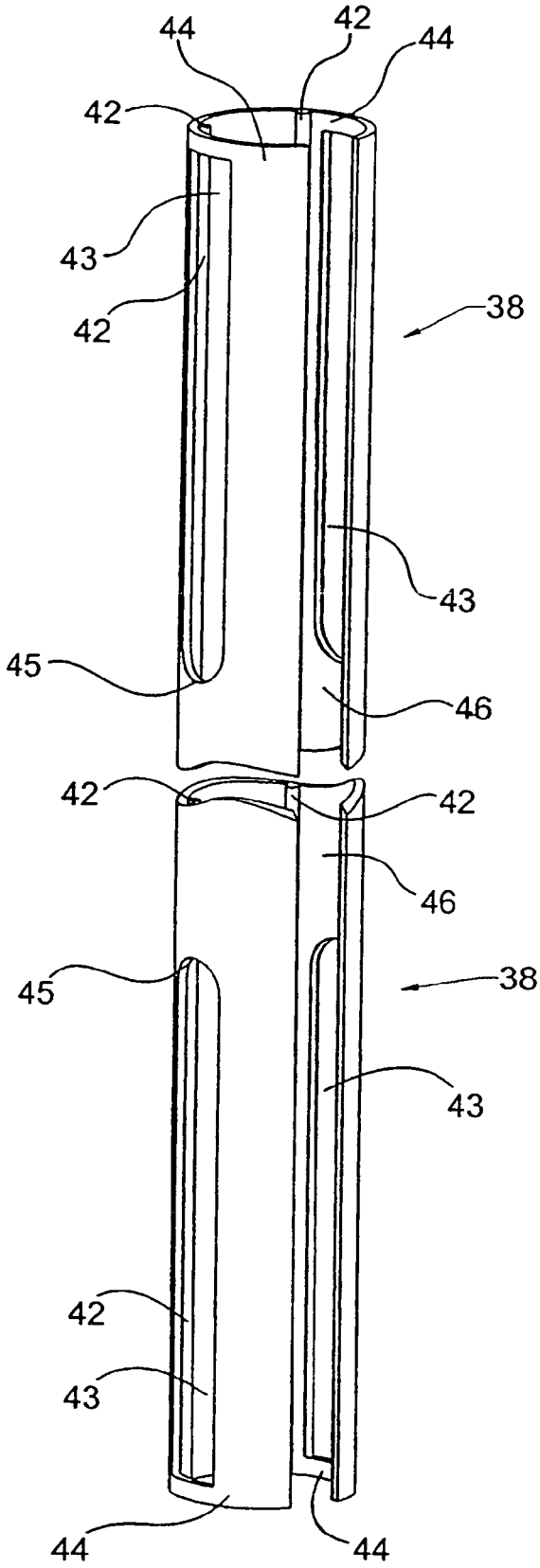

As is shown in FIGS. 22 to 24, there is a wide variety of bore holes or openings, e.g., in the shape of an elongated hole 47, inside the clamping inserts 25. In addition to countersink bore holes 56, there are fastening bore holes 57, threaded bore holes 58 and through-holes 59 and 60 at different locations in order to realize a universal applicability of the clamping insert 25 with short covers 38 for the upper mounting 3 and lower mounting 10 and for the counterbearing 8, respectively, as well as with a device for actuating a door of this type without clamping, in which case the cover 38 extends over the entire vertical axis H of the glass door 2. The clamping insert 25 is closed toward the outside by corresponding coverings 37 or cover panels 26. Projections 41 which snap into the corresponding bore holes 57 located underneath them are formed at the coverings 37 in order to achieve an invisible fastening between the covering 37 and the clamping insert 25.

Figure 21:
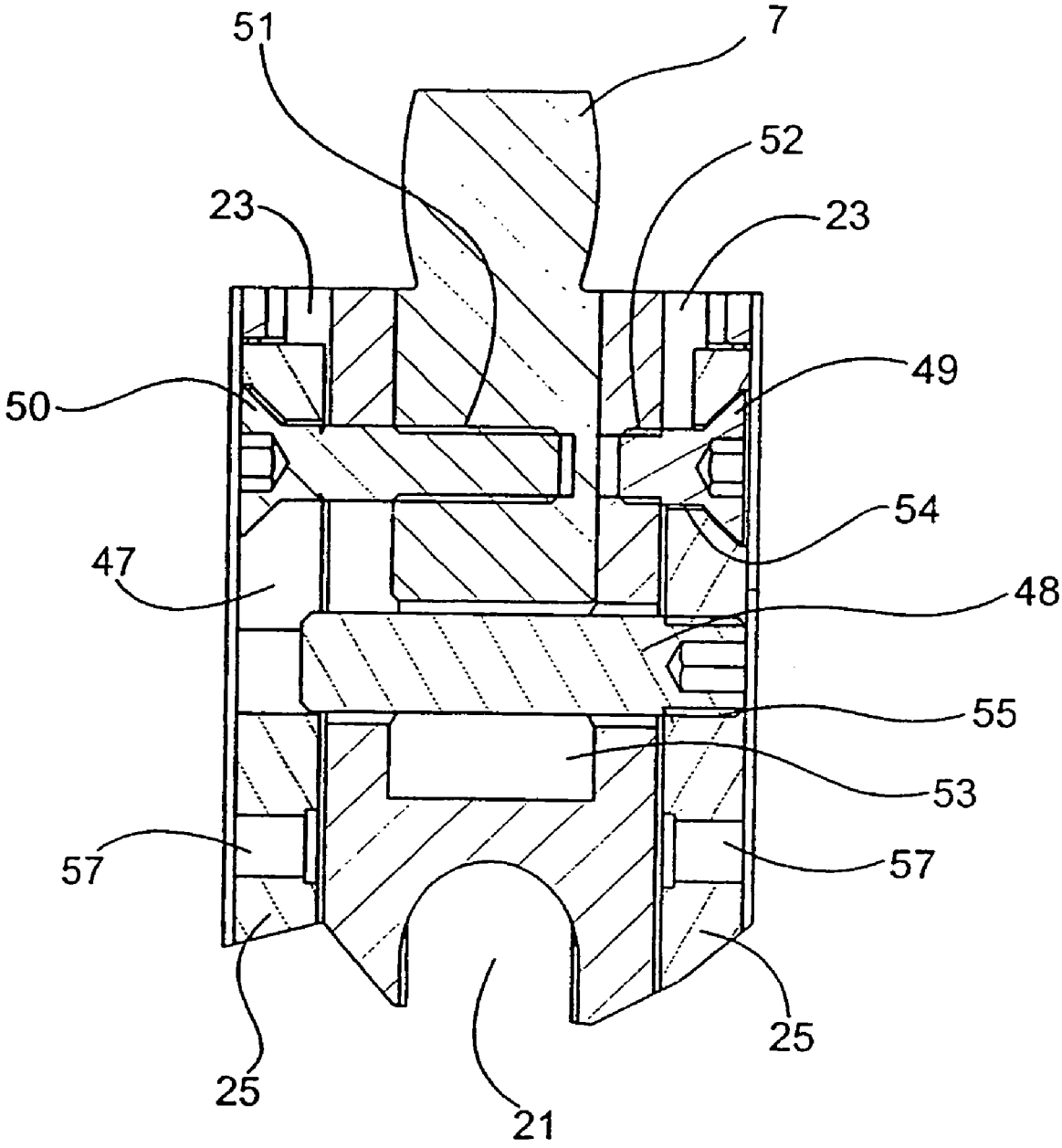
FIG. 21 shows an upper mounting in a partial view with lift-out protection.

FIG. 21 shows an upper mounting 3 which is used for all-glass doors 2 with a glass leaf.

The upper mounting 3 substantially comprises the mounting body 4 having the glass receptacle 21 for the glass leaf 2 of the all-glass door. A pocket hole 53 is located in the upper area of the mounting body 4, the displaceable bearing pin 7 of an upper bearing, e.g., in the transom 9 or the like, penetrating into this pocket hole 53. The mounting body 4 is defined laterally by the clamping inserts 25 (clamping plates). The clamping inserts 25 are covered in turn by cover panels 26, 37 and fitted over the fastening bore holes 57. When the cover panels 26, 37 are removed, two screw elements, namely, a holding screw 50 and a securing screw 48, are accessible inside the upper mounting 3. The holding screw 50 is embedded by its head inside an elongated hole 47 oriented in axial direction and penetrates with its thread into an internal thread 51 located in the bearing pin 7. When the bearing pin 7 is moved out (see FIG. 21), the holding screw 50 is tightened so that a frictional and positive connection is formed between the bearing pin 7 and the upper mounting 3.

Directly below the end of the bearing pin 7 which penetrates into the pocket hole 53, the securing screw 48 extends orthogonal to the longitudinal axis of the mounting. The securing screw 48 accordingly penetrates the pocket hole 53. The length of the securing screw 48 is adapted to the thickness of the mounting body 4 or of the clamping inserts 25. However, the securing screw 48 is arranged at an offset of 180° to the holding screw 50. This means that, e.g., the securing screw 48 lies outside the space and the holding screw 50 is located inside the space when the door leaf is closed. Accordingly, when the door is closed, no one can unscrew both screws, namely, the securing screw 48 and the holding screw 50, simultaneously in order to lower the bearing pin 7 into the pocket hole 53 and then remove the door leaf from its operational position.

If the securing screw 48 which is screwed into an internal thread 55 of the clamping insert 25 were removed, it becomes clear that loosening the holding screw 50 can cause the bearing pin 7 to be lowered only if the securing screw 48 is removed beforehand.

This situation, namely, the removal of the holding screw 50 from the bearing pin 7 while the securing screw 48 is inserted in the thread 55 at the same time, does not allow the bearing pin 7 to be lowered.

As is clear from the embodiment example shown in FIG. 21, in contrast to the prior art shown in DE 89 105 69.9 U1, the door is also operative when the holding screw 50 is removed because the bearing pin 7 can not be pushed out of the upper bearing due to the securing screw 48. At the same time, the entire all-glass door is also protected from being lifted out in that the securing screw 48 is offset by 180° relative to the holding screw 50 when viewing the upper mounting 3 from the top.

What is claimed is:

1. A mounting arrangement for mounting a glass leaf between a transom and a floor, said leaf having a central axis, a side edge parallel to said axis, and bore holes adjacent to said side edge, said arrangement comprising:

an upper mounting having an elongate mounting body with a pair of clamps which receive said leaf therebetween, said mounting body having a pair of longitudinal channels extending over respective clamps and a pair of screw holes which align with a pair of bore holes in said leaf for receiving fastening screws through the clamps and the leaf;

a lower mounting having an elongate mounting body with a pair of clamps which receive said leaf therebetween, said mounting body having a pair of longitudinal channels extending over respective clamps and a pair of screw holes which align with a pair of bore holes in said leaf for receiving fastening screws through the clamps and the leaf;

a cover extending over each of said mountings, each said cover having a pair of elongate apertures which align with respective said channels;

a clamping insert received in each of said channels and extending over the cover, each said insert having a recess and a pair of holes in the recess for said screws; and a cover panel received in each said recess.

2. The mounting arrangement of claim 1, wherein each mounting body has a slot separating said clamps, each clamp having a clamping surface which can be clamped against said glass leaf.

3. The mounting arrangement of claim 1, wherein each mounting body is provided with a groove, and each cover is provided with a projection which engages in said groove to prevent rotation of said cover relative to said mounting body.

4. The mounting arrangement of claim 1, wherein the mounting body of the upper mounting is substantially identical to the mounting body of the lower mounting.

5. The mounting arrangement of claim 1 for mounting a glass leaf having a pair of cutouts at the top and bottom of said side edge, said cutouts being vertically aligned with said boreholes, said mountings being received in respective said cutouts so that said clamps extend over said bore holes.

6. The mounting arrangement of claim 5 for mounting a glass leaf having a contact edge extending diagonally of said side edge in each of said cutouts, each said mounting body having an inclined surface that makes contact with a respective said contact surface.

7. The mounting arrangement of claim 1, further comprising an end cap received on each of the upper and lower mountings.

8. The mounting arrangement of claim 7, wherein each said end cap has a pair of projections that are received in respective said channels.

9. The mounting arrangement of claim 1, further comprising a counterbearing mounted in said transom, said upper mounting comprising a bearing pin displaceably mounted in said mounting body and engaging in said counterbearing.

10. The mounting arrangement of claim 9 for mounting a glass leaf beside a stationary sidewall, neither of said mountings nor said counterbearing engaging said sidewall.

11. The mounting arrangement of claim 9, wherein each of said covers comprises a tube which can be slid over the respective mounting body.

12. The mounting arrangement of claim 11, further comprising a cover comprising a tube which can be slid over said counterbearing.

13. The mounting arrangement of claim 11, wherein each said tube comprises a longitudinal slot that provides access for fitting said glass leaf between said clamps.

14. The mounting arrangement of claim 9, further comprising an adjusting screw which engages the bearing pin to fix the position of the bearing pin in the mounting body of the upper mounting.

15. The mounting arrangement of claim 14, wherein the bearing pin comprises a transverse threaded bore hole which receives the adjusting screw.

16. The mounting arrangement of claim 15, wherein the transverse threaded bore hole is a blind hole.

17. The mounting arrangement of claim 14, wherein the mounting body of the upper mounting has a slot which receives the adjusting screw therethrough, whereby the vertical position of the bearing pin can be adjusted by moving the adjusting screw vertically in the slot before tightening the adjusting screw to fix the position.

18. The mounting arrangement of claim 17, wherein the slot is provided in one of the channels of the mounting body of the upper mounting, the corresponding clamping insert having a slot which aligns with the slot in the channel.

19. The mounting arrangement of claim 14, wherein the upper mounting comprises a hole which receives the bearing pin and a securing screw which is projects into the hole below the bearing pin.

20. The mounting arrangement of claim 19, wherein the adjusting screw and the securing screw have heads arranged on opposite sides of the mounting body.

* * * * *